United States Patent [19]
MacPherson

[11] 4,402,419
[45] Sep. 6, 1983

[54] BOTTOM WALL FOR CONTAINER

[75] Inventor: William C. MacPherson, Downers Grove, Ill.

[73] Assignee: The Continental Group, Inc., New York, N.Y.

[21] Appl. No.: 919,187

[22] Filed: Jun. 26, 1978

[51] Int. Cl.³ ..... B65D 8/04
[52] U.S. Cl. ..... 220/70; 220/1 BC; 220/66
[58] Field of Search ..... 220/70, 66, 67, 1 BC, 220/70.1 B; 215/1 C; 113/120 H

[56] References Cited

U.S. PATENT DOCUMENTS

| | | | |
|---|---|---|---|
| 839,678 | 12/1906 | Trenaman | D9/216 X |
| 1,824,907 | 9/1931 | Levmer | 220/1 BC X |
| 1,888,319 | 11/1932 | Hopkins | 220/352 |
| 1,931,210 | 10/1933 | Steinacher | 713/120 H X |
| 2,116,199 | 5/1938 | Held | 220/1 BC X |
| 2,142,743 | 1/1939 | Calleson et al. | 220/66 |
| 2,157,896 | 5/1939 | Held | 220/1 BC X |
| 2,195,257 | 3/1940 | Paris | 220/1 B |
| 2,339,763 | 1/1944 | Calleson et al. | 220/70 X |
| 2,971,671 | 2/1961 | Shakman | 220/66 |
| 3,038,627 | 6/1962 | Daley | 220/70 X |
| 3,043,461 | 7/1962 | Glassco | 220/70 X |
| 3,100,576 | 8/1963 | Frank | 215/1 C |
| 3,215,300 | 11/1965 | Lynch | 215/1 C X |
| 3,409,167 | 11/1968 | Blanchard | 220/66 |
| 3,426,939 | 2/1969 | Young | 220/66 |
| 3,904,069 | 9/1975 | Toukmanian | 220/66 |
| 3,923,190 | 12/1975 | Roth | 220/67 |
| 3,964,412 | 6/1976 | Kitsuda | 113/120 H X |
| 3,979,009 | 9/1976 | Walker | 220/70 X |
| 4,147,271 | 4/1979 | Yamaguchi | 220/66 |

FOREIGN PATENT DOCUMENTS

| | | | |
|---|---|---|---|
| 2731876 | 2/1978 | Fed. Rep. of Germany | 220/70 |

*Primary Examiner*—Allan N. Shoap
*Attorney, Agent, or Firm*—Charles E. Brown

[57] ABSTRACT

A seamless metal container including a body and an integral bottom wherein the bottom has controlled distension characteristics. The bottom is joined to the body by a radius and the bottom has a flat central portion offset inwardly into the body and being joined to the radius by an annular generally frustoconical radially outer portion. The offset of the flat central portion into the interior of the body is less than the thickness of the metal of the bottom and is such that in conditions of use under pressure with the bottom distended, the bottom becomes flat.

1 Claim, 4 Drawing Figures

BOTTOM WALL FOR CONTAINER

This invention relates to new and useful improvements in container constructions, and more particularly to a can intended for beverages under pressure wherein the bottom thereof is so configurated that under conditions of use wherein the can is internally pressurized the bottom assumes a flat state.

The distension of the bottom of a can under pressure is a problem recognized in the industry, and numerous efforts have been made to overcome this problem. Typical examples of such efforts are the patents to Toukmanian U.S. Pat. Nos. 3,904,069 and Walker 3,979,009. In accordance with the Toukmanian theory, the bottom is inwardly domed and is surrounded by an annular portion which distends downwardly below the plane of the initial bottom and defines an annular supporting surface when the container is pressurized.

Walker also has a domed central portion formed in his bottom, but this central portion is surrounded by a downwardly sloping annular portion which is also recessed relative to the initial plane of the bottom and is surrounded by a further annular portion. When the bottom is distended, the intersection between the dome and the inner annular portion projects down below the initial bottom plane and defines an annular support.

Other examples of prior art are clearly taught in the Toukmanian and Walker patents, including the provision of a radially outer depending rib which surrounds a domed central portion and projects downwardly to the extent that this rib functions as the supporting surface in all conditions of the bottom.

The prior art bottom structures require complex tooling and relatively great working of the metal of the bottom with a result weakening of the bottom due to excess thinning in certain areas.

It has been found in accordance with this invention that the working of the bottom may be held to a minimum and that the problem of distension can be readily overcome by merely providing the bottom with a flat central portion which is inwardly offset from the general plane of the bottom. The bottom is joined to the body of the can by way of a small diameter radius, and the bottom is completed by an annular radially outer portion extending between the offset flat central portion and the radius. The radius permits the resisted deflection of the bottom and the doming or distension of the bottom, as reinforced by the offset central portion, is restricted to a dimension less than the thickness of the metal of the bottom so that the offsetting of the flat central portion of the body into the interior of the body may be less than the thickness of the metal of the bottom. With this bottom construction, when the body is distended under pressure in use, the bottom assumes an overall flat or planar condition wherein full support of the container on the flat bottom is obtainable.

It has been found that this bottom construction is functional in conjunction with standard beverage cans which are of one-piece body and bottom construction and are formed either of conventional can maker's steel or aluminum alloy of generally acceptable thicknesses.

With the above and other objects in view that will hereinafter appear, the nature of the invention will be more clearly understood by reference to the following detailed description, the appended claims, and the several views illustrated in the accompanying drawings.

IN THE DRAWINGS

Figure 4:
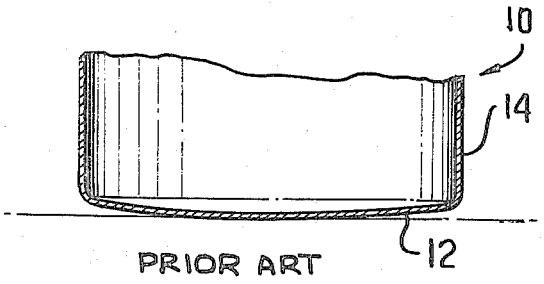
FIG. 4 is a fragmentary vertical sectional view through the bottom portion of a prior art container wherein the bottom is initially substantially flat.

As discussed above, when a container, such as a beverage can, is filled and internally pressurized, the bottom becomes distended and does not provide a suitable base for supporting the container in a stable condition. In FIG. 4 there is illustrated a conventional beverage can 10 having a bottom 12 formed integrally with a body 14 thereof. The bottom 12 is initially flat or substantially flat, and when the can 10 is internally pressurized in a condition of use, the bottom 12 becomes distended, as shown in FIG. 4, and is rounded in cross section so as to provide a very unstable base for the can. It is the purpose of this invention to avoid this undue distension of the bottom.

Figure 1:
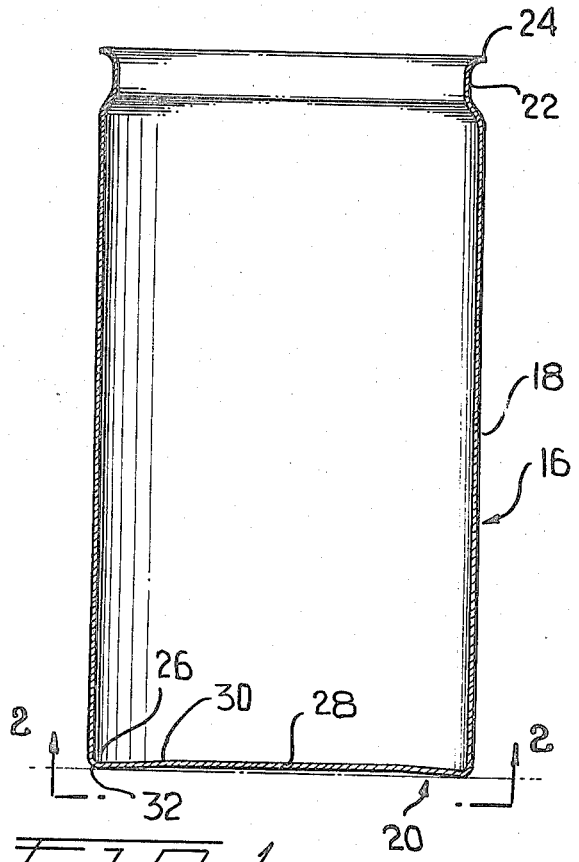
FIG. 1 is a vertical sectional view taken through a container formed in accordance with the invention.

Referring now to FIG. 1, there is illustrated a container formed in accordance with this invention. The illustrated container is in the form of a beverage can 16, and has the proportions of a conventional twelve ounce beverage can, although the invention is not so limited. The can 16 has a cylindrical body 18 and an integral bottom generally identified by the numeral 20.

Although the upper end of the body 18 may be of any conventional construction, the body 18 is illustrated with a necked-in upper portion 22 terminating in a customary flange 24 suitable for the double seaming of a closure to the body 18 in a conventional manner.

The present invention resides in the bottom 20. First of all, the bottom 20 is joined to the body 18 by a small diameter radius 26 which is of a dimension greater than the thickness of the metal of the bottom 20.

Next, the bottom 20 is characterized in that it has a flat central portion 28 which is offset axially into the interior of the body 18. The flat central portion 28 is joined to the radius 26 by an annular radially outer bottom portion 30 which is generally frustoconical.

It is to be particularly noted that the offsetting of the flat central portion 28 into the interior of the body 18 is minimal, the dimension of the offsetting being less than the thickness of the metal of the bottom 20.

Figure 3:
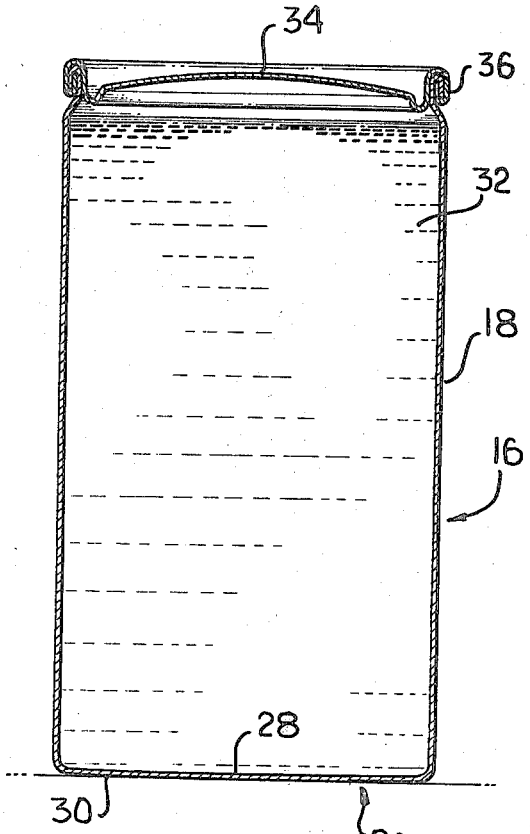
FIG. 3 is a vertical sectional view similar to FIG. 1, showing the container in its filled and closed condition with the container being internally pressurized and the bottom distended.
Figure 2:
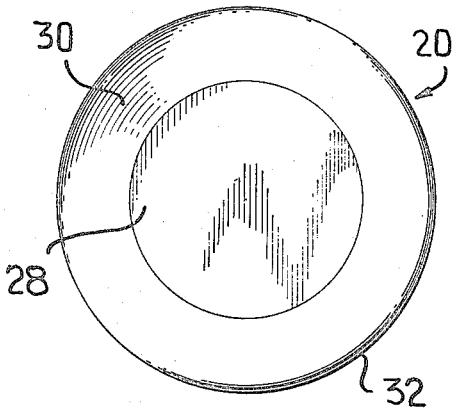
FIG. 2 is a bottom plan view of the container of FIG. 1, taken generally along the line 2—2 of FIG. 1, and shows the bottom arrangement.

Referring now to FIG. 3, it will be seen that the can 16 has been filled with a product 32, normally a beverage, and has been closed by a conventional end unit 34 which is secured to the upper end of the body 18 by means of a conventional double seam 36. Further, the can 16 has been internally pressurized, with the net result being that the bottom 20 has become radially outwardly distended. However, the distension of the bottom 20 is limited, and the bottom 20 now assumes a flat substantially planar state with the flat central portion 28 having moved axially outwardly from within the body 18 and the frustoconical annular portion 30 having become flat and coplanar with the flat central portion 28. Thus, in the filled and pressurized can 16 the bottom 20 is flat throughout its entirety. Thus, the bottom 20 in the filled and pressurized condition of the can 16 provides a stable base.

At this time it is also pointed out that initially a bottom 20 also provides a stable base even though the supporting area thereof is generally in the form of a ring 32 disposed adjacent the radius 26. It is also to be understood that when the can 16 is opened and the internal pressure removed, the bottom 20 will substantially recover its initial configuration wherein the ring 32 will once again provide a stable base.

Cans in accordance with this invention have been made and tested. The test cans have had a conventional body diameter of 2 11/16 inches and have been formed both of conventional can maker's quality aluminum alloy and steel. The offset of the flat central portion 28 has been on the order of 0.005 inch for both aluminum alloy and steel, with the thickness of the aluminum alloy being on the order of 0.010 to 0.014 inch and the steel being 55 to 80 pound box base steel having a thickness on the order of 0.006 to 0.009 inch (0.0088 inch). Further, such cans have been subjected to internal pressures in excess of 90 p.s.i. with the bottom 20 distending only to its substantially flat condition as illustrated in FIG. 3.

The simplicity of the bottom construction of this invention is apparent when compared with the complex bottom constructions of the prior art, and it will be readily apparent to one skilled in the can making art that the tooling required to shape the bottom 20 is much simpler than the required prior art tooling. It is further apparent that there is no undue stressing of the metal of the bottom 20 during the slight offsetting of the flat central portion 28.

Although only a preferred embodiment of the bottom structure has been specifically illustrated and described herein, it is to be understood that minor variations may be made in the bottom structure without departing from the spirit and scope of the invention as defined by the appended claims.

I claim:

1. A seamless metal container comprising a body and an integral bottom, said bottom having controlled distension characteristics and being joined to said body by a radius, said bottom having a flat central portion offset inwardly into said body and being joined to said radius by an annular generally frustoconical radially outer portion, the inward offsetting of said flat central portion being equal to the distension of said bottom under pressure during conditions of use whereby said bottom becomes flat.

* * * * *